US006481873B1

(12) United States Patent
Smith

(10) Patent No.: US 6,481,873 B1
(45) Date of Patent: Nov. 19, 2002

(54) LENS FOR A WARNING LIGHT

(75) Inventor: Todd J. Smith, Deep River, CT (US)

(73) Assignee: Whelen Engineering Company, Inc., Chester, CT (US)

( * ) Notice: Subject to any disclaimer, the term of this patent is extended or adjusted under 35 U.S.C. 154(b) by 0 days.

(21) Appl. No.: 09/904,792

(22) Filed: Jul. 13, 2001

(51) Int. Cl.[7] ..... F21V 5/02

(52) U.S. Cl. ..... 362/339; 362/340; 362/338; 362/335

(58) Field of Search ..... 362/223, 327, 362/335, 338, 339, 340

(56) References Cited

U.S. PATENT DOCUMENTS 4,488,208 A * 12/1984 Miller ..... 362/339
5,040,103 A * 8/1991 Lyons ..... 362/268
5,582,481 A * 12/1996 Natsume ..... 362/336

* cited by examiner

*Primary Examiner*—Laura K. Tso
*Assistant Examiner*—Ronald E. DelGizzi
(74) *Attorney, Agent, or Firm*—Alix, Yale & Ristas, LLP

(57) ABSTRACT

A convex lens for a warning light is provided with a plurality of prism-shaped prismatic elements projecting from the lens concave inner surface. The configuration and angular orientation of each prismatic element is selected to compensate for the curvature of the lens so that light refracted by each prismatic element emerges from the lens outer surface at substantially equivalent angles relative to an optical axis of the light. A preferred embodiment of the lens includes a matrix of prismatic elements that refract light incident on planar surfaces of the prismatic elements to an angle of 45° relative to an optical axis of the light. Each prismatic element also includes a convex radius at the convergence of the two refractive surfaces and concave radii at the junction of the planar surfaces with the inner surface of the lens. Light incident on these concave and convex surfaces is refracted along a range of angles to fill in the radiation pattern produced by the lens.

20 Claims, 6 Drawing Sheets

LENS FOR A WARNING LIGHT

BACKGROUND OF THE INVENTION

1. Field of the Invention

The present invention relates generally to lights, and more particularly to warning lights providing a wide-angle radiation pattern. More particularly, the present invention is directed to a warning light having a radiation pattern balanced between forward illumination and off-angle radiation in a horizontal plane.

2. Description of the Related Art

Lights serving warning function preferably provide a wide-angle light radiation pattern where the light is radiated generally parallel to the road surface. A warning pattern is distinguishable from an illumination pattern in which a wide area radiation pattern of light is directed generally toward the road surface (or other area to be illuminated) for the purpose of area illumination. U.S. Pat. No. 5,040,103, assigned to the assignee of the present invention, discloses a light assembly for wide area illumination in which a lens insert equipped with a Fresnel lens and parallel optical spreader bars cooperates with a lens cover including optical spreader bars perpendicular to those of the lens insert. The lens cover and insert spread light and direct the light generally downwardly for the purpose of area illumination.

U.S. Pat. No. 4,954,938 and 5,045,982, both assigned to the assignee of the present invention, disclose warning lights with wide-angle radiation patterns. Complex reflectors in combination with light spreading lenses provide a wide-angle radiation pattern from a compact arrangement. U.S. Pat. No. 4,866,329, also assigned to the assignee of the present invention, discloses a warning light having a wide-angle radiation pattern. This warning light is an example of a flush mounted light having an elongated paraboloidal reflector and a single light source. The wide-angle radiation pattern is provided by a convex lens secured to the reflector. The inside surface of the lens includes a plurality of parallel optical spreader bars. The spreader bars comprise generally vertically oriented elongated arcuate projections in the form of spherical surfaces separated from each other by flat areas of lens material. Light incident on the inside surface of the lens is refracted by the spreader bars to form a wide-angle radiation pattern. The spreader bars are separated by flat areas that permit some light to pass more directly through the lens to provide forward illumination.

All of these prior art designs present a compromise between lights having a simple configuration producing a simple light pattern and comparatively complex lights having widely dispersed light patterns. Typical prior art wide-angle warning lights use complicated reflector and lens configurations that result in light losses and reduced straight on visibility. Also typically, the more dispersed the light is, the less intense a warning light appears from any given position. Many of the prior art lights include a window portion directly opposite the light source to permit at least some of the light to pass through the lens or lenses unimpeded, thus improving the straight on visibility of the warning light. Naturally, it is highly desirable to provide a warning light which is capable of providing the required pattern of illumination while being of simple construction, economic to manufacture, easy to install, and not causing an increase in overall vehicle height, width, or a substantial increase in wind resistance.

SUMMARY OF THE INVENTION

It is an object of the present invention to provide a warning light which produces a wide-angle light pattern, particularly in a single preferably horizontal plane.

Another object of the present invention is to provide a warning light which is compact, i.e., is characterized by reduced height and depth, while providing light radiation of high intensity over a wide-angle.

It is a further object of the present invention to provide a light which is characterized by an efficient construction, ease of assembly and installation, and which is inexpensive to manufacture.

A still further object of the present invention is to provide a warning light in which intense light radiation is distributed in a horizontal plane through an arc of 90° balanced to extend from an angle of 45° offset from either side of the warning light.

Briefly stated, a preferred form of the present invention comprises a convex lens for a warning light having an inner surface including a plurality of vertically disposed prismatic elements arranged to spread light passing through the lens over an arc of 90° in a horizontal plane. Each prismatic element comprises a rounded prism-shaped rib having parallel concave surfaces where each rib joins the inner lens surface and a convex surface connecting the two substantially planar sides of the prism. The prismatic elements are separated by quasi-flat portions of the lens having a generally uniform thickness with a large radius of curvature and which are termed flat portions. The flat portions permit light to pass through the lens in a more direct path. The refractive material and curved surfaces of the lens will result in some refraction of light incident on the flat portions, however, the angular deflection of the light and associated attenuation are minimal when compared with that of the prismatic elements.

Each prismatic element acts as a prism, with light bending upon incidence with each of the planar surfaces and bending again upon exiting the outer surface of the lens. Because the lens is preferably used in conjunction with a parabolic reflector, a significant percentage of the light incident upon each optic will have a known angle of incidence, i.e., parallel to an optical axis of the reflector. Since the reflector may not be symmetrically disposed around a center point, the term "optical axis" is used to identify a line perpendicular to the reflector and passing through a center point of the reflector and lens.

The invention optimizes the configuration and orientation of each prismatic element so that light parallel to the optical axis and incident on the planar surfaces of each prismatic element exits the outer surface of the lens at an angle of 45° relative to the optical axis. Optimization of each prismatic element is accomplished by adjusting the angular orientation and configuration to compensate for the curvature of the lens. This results in light incident upon each prismatic element being consistently refracted to the desired angle without regard to the relative position of the prismatic element on the curve of the lens. The prismatic elements are generally equally spaced as they progress away from the center of the lens.

An arrangement of parallel, spaced apart prismatic elements defines a prismatic matrix that distributes light incident on the lens inner surface in a pattern having excellent straight-on visibility and additional points of brightness horizontally offset 45° to each side of the light. The convex and concave surfaces associated with each prismatic element spread light within the 90° arc to fill in the radiation pattern produced by the lens. The resulting wide-angle radiation pattern is produced without use of complex lenses, multiple lenses, complicated reflectors or multiple light emitting elements.

These and other objects, features and advantages of the invention will become readily apparent to those skilled in the art upon reading the description of the preferred embodiments in conjunction with accompanying drawings.

DETAILED DESCRIPTION OF THE PREFERRED EMBODIMENT

With reference to the drawings wherein like numerals represent like parts throughout the several figures, a lens for a warning light in accordance with the present invention is designated generally by the numeral 100. A lens in accordance with the present invention will normally be used to produce a wide-angle radiation pattern that is directed in a horizontal plane.

Figure 11:
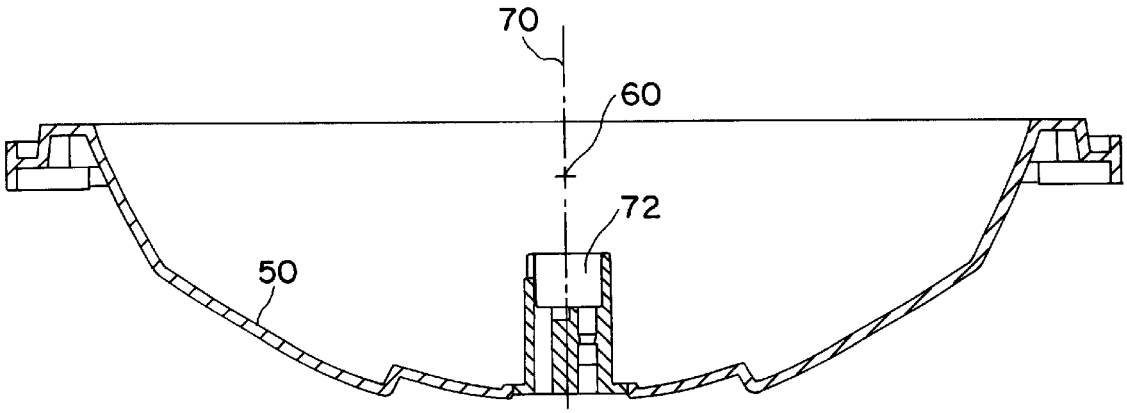
FIG. 11 is a sectional view of a reflector appropriate for use in conjunction with the lens of FIG. 1.

With reference to FIG. 11, the lens is preferably used in conjunction with a warning light that incorporates a modified parabolic reflector 50 having a focus 60 and a socket 70 for a light source (not illustrated). For purposes of description, an optical axis 70 is drawn through the focal point 60 of the reflector 50. The optical axis 70 is perpendicular to the reflector and is generally parallel to light re-directed by the reflector.

In such a warning light, substantial amounts of light produced by the light source are reflected from the parabolic reflector along parallel optical paths that are generally uniformly distributed. Parabolic reflectors are used because they efficiently and uniformly reflect light produced by a light source positioned at the focus of the parabola in a well-defined pattern. Light reflected from such a light source/parabolic reflector arrangement is directed away from the reflector generally perpendicular to the assembly or parallel to the optical axis 70.

While a parabolic reflector efficiently reflects light from a light source, the radiation pattern produced is highly directional. Such a directional light pattern is ill suited for area illumination or for providing the wide-angle visibility that may be needed in a warning light. Lenses and alternative reflector configurations are frequently used to redirect light from the light source into a dispersed radiation pattern useful for area illumination or, as in the case of the present invention, a wide-angle warning function.

Figure 2:
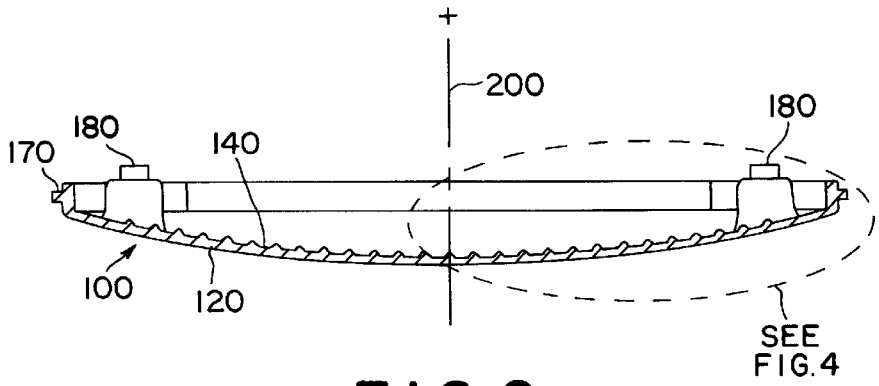
FIG. 2 is a sectional view through the lens of FIG. 1 taken along line B—B thereof.
Figure 1:
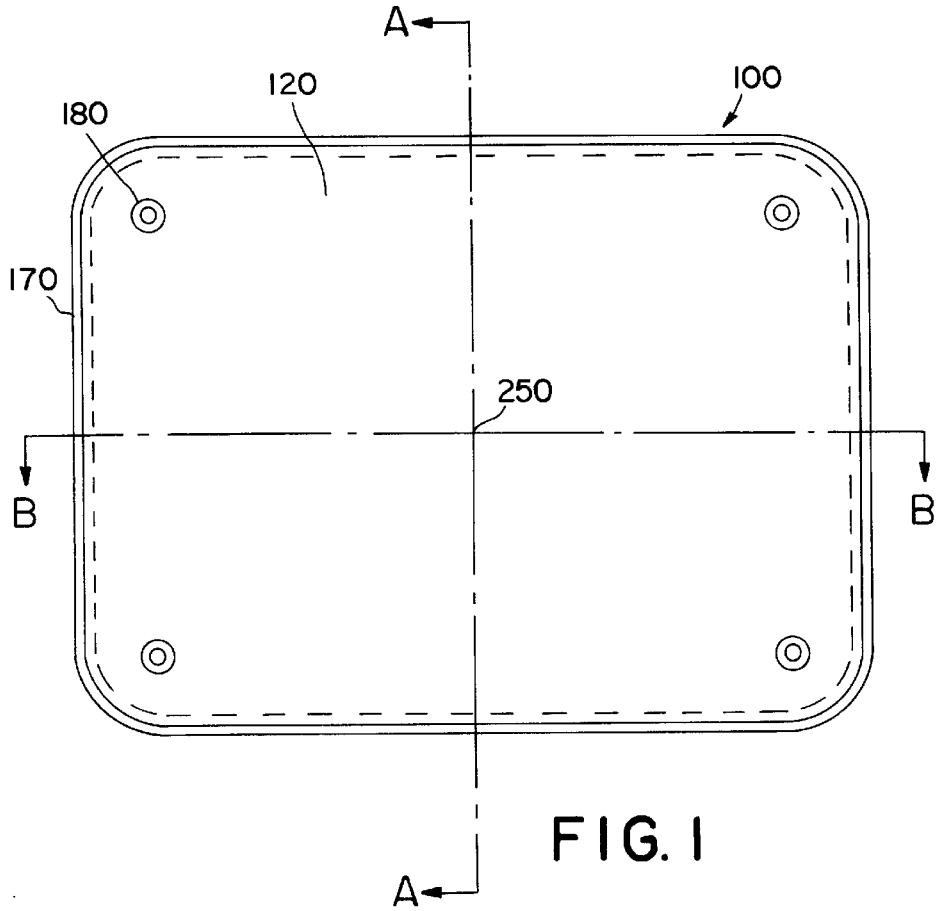
FIG. 1 is a front view, partly in phantom, of a lens for a warning light in accordance with the present invention.
Figure 3:
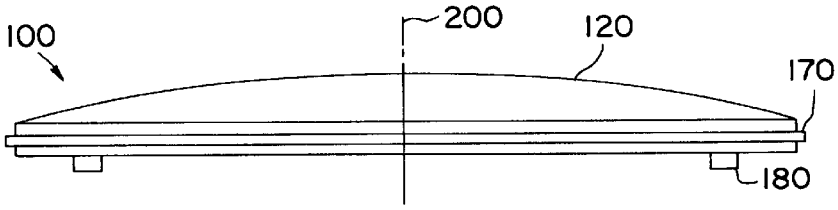
FIG. 3 is a bottom plan view of the lens of FIG. 1.
Figure 5:
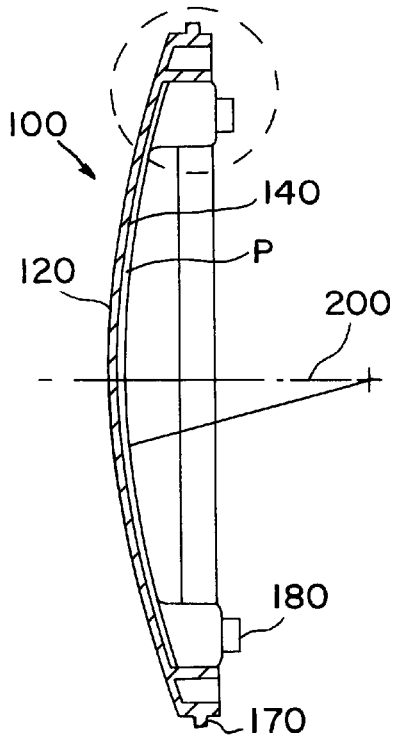
FIG. 5 is a vertical sectional view through the lens of FIG. 1 taken along line A—A thereof.
Figure 5A:
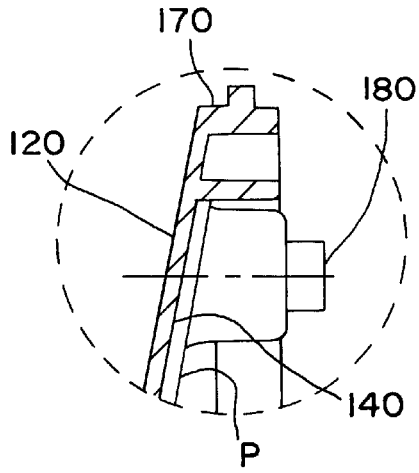
FIG. 5A is an enlarged detail of a lens mounting structure illustrated in FIG. 5.

FIGS. 1–3 and 5 and 5A illustrate the configuration of one preferred embodiment of a lens 100 for a warning light in accordance with the present invention. The lens 100 is generally configured as a rounded rectangle having a convex outer lens surface 120 and corresponding concave inner surface 140. In the preferred embodiment, two radii of curvature define the convex shape of the lens surface. FIG. 2 illustrates that in a horizontal plane along line B—B of FIG. 1 the curvature of the lens surfaces 120, 140 are defined by a radius of curvature of approximately 16.8 inches. FIG. 5 illustrates that in a vertical plane along line A—A of FIG. 1 the curvature of the lens surfaces 120, 140 are defined by a radius of curvature of approximately 10.23 inches. It should be understood that the specific shape and configuration of the lens is given for the purpose of description only. The principles of the invention are applicable to a wide variety of light assembly lenses having a convex or concave configuration.

The perimeter of the lens is traversed by a continuous lip structure 170 to provide a stable junction and sealing point with a reflector or light body (not illustrated). A mounting projection 180 that is configured to receive mounting hardware and secure the lens to a warning light body or reflector in a stable mounted position is located at each of the four corners of the lens. The mounting projections 180 project rearwardly from the inside surface 140 of the lens.

Figure 8:
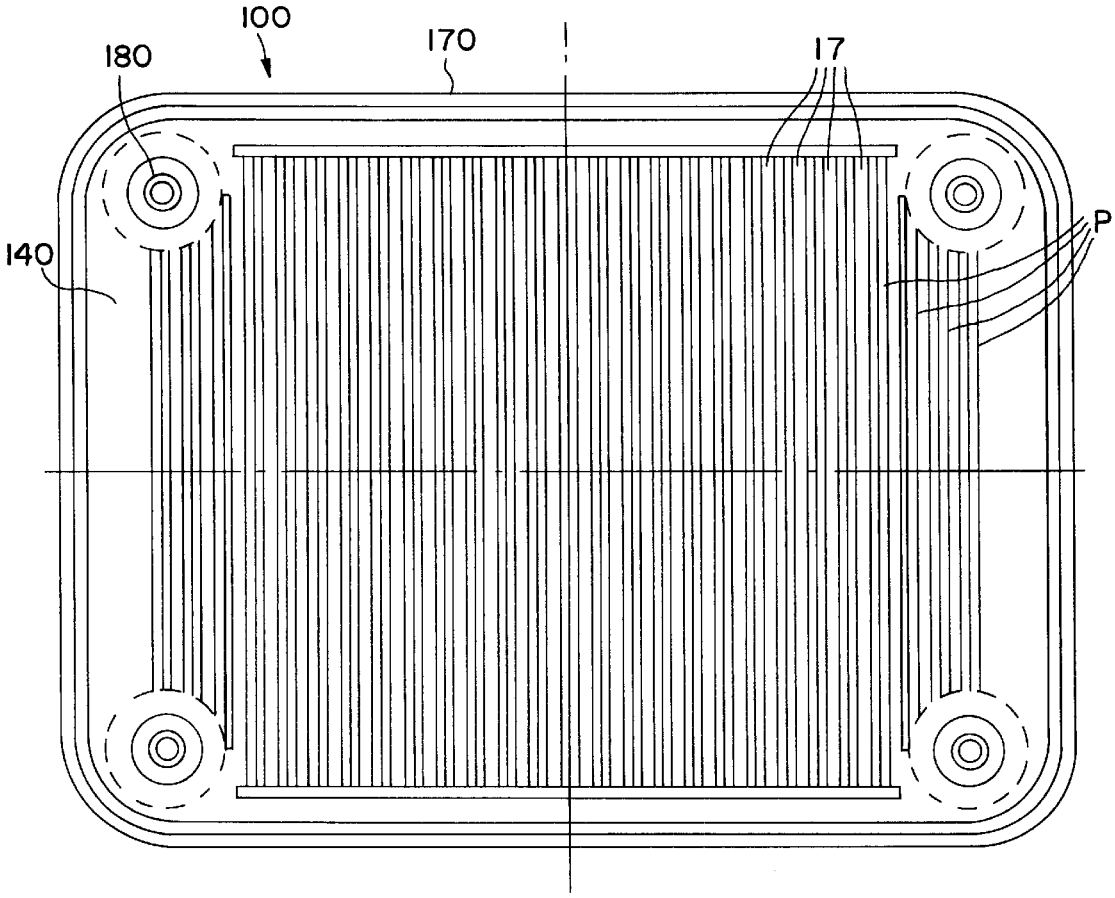
FIG. 8 is a rear plan view of the lens of FIG. 1.

FIGS. 2, 5 and 8 illustrate the configuration of the inside surface 140 of the lens 100. Spaced parallel prismatic elements P are vertically arranged on the inside surface 140 of the lens 100. The prismatic elements P are separated by spaces 17 that permit significant amounts of light to exit the lens with minimum redirection, providing superior straight-on visibility. The vertical arrangement and configuration of prismatic elements P provides the desired horizontal light-spreading pattern.

The configuration of each prismatic element P and their arrangement on the inside surface 140 of the lens 100 is best described with reference to FIGS. 4, 6, 9 and 10. The lens is disposed about a center point 250 and can be conceptually divided into equal halves horizontally and vertically by centerlines A—A and B—B passing through the center point 250. Each prismatic element P can be described as a rounded prism shape that includes two substantially planar surfaces S1, S2 joined at an inwardly projecting apex by a convex surface 21 and connected to the inside surface of the lens by concave surfaces 19.

Figure 9:
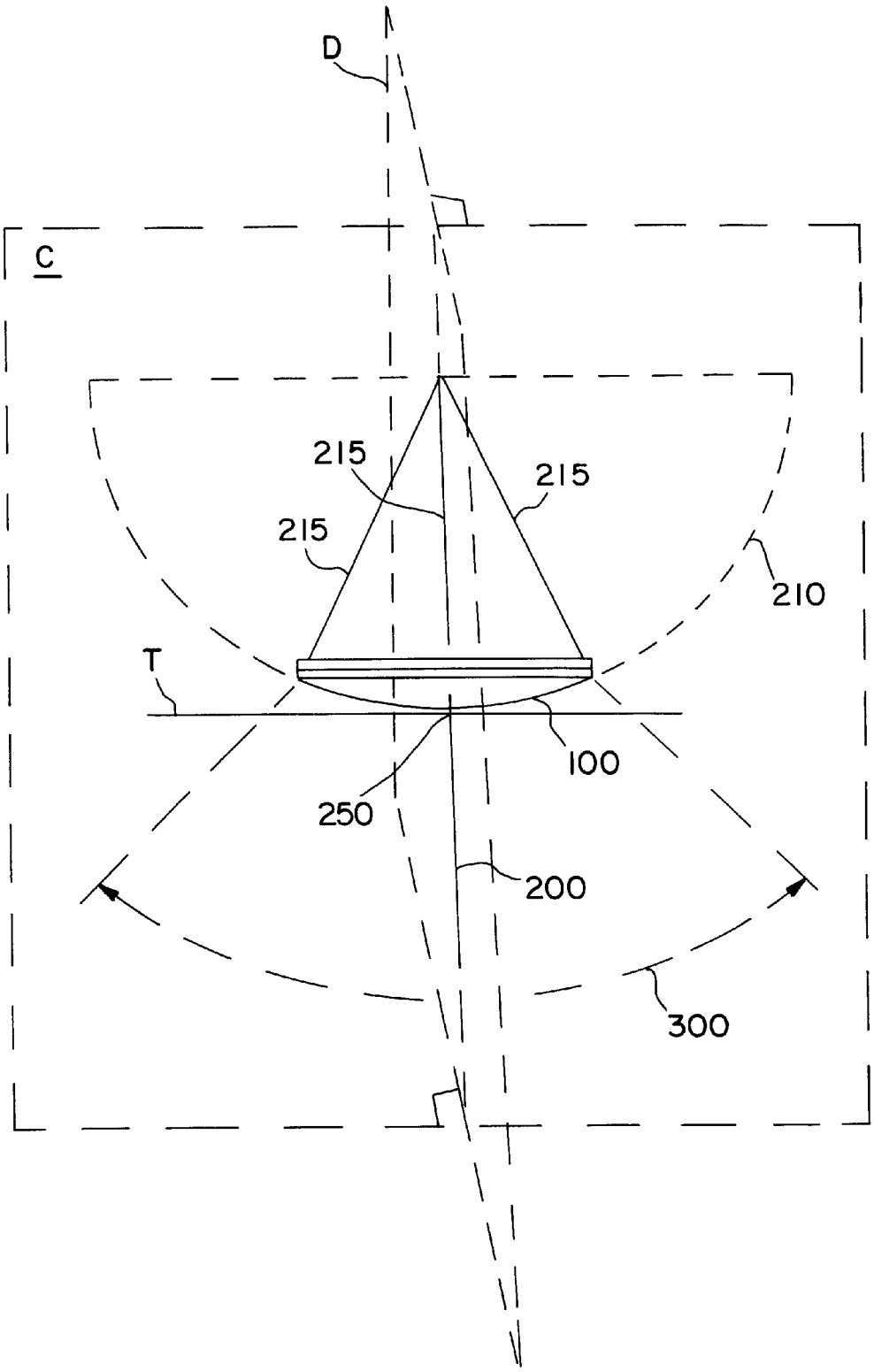
FIG. 9 is a top plan view of the lens of FIG. 1 situated in a field illustrating various geometrical and optical relationships.

Some of the geometric and optical relationships used to discuss the preferred embodiment of the lens 100 are best described with reference to FIG. 9. FIG. 9 is a top plan view of the lens 100 drawn in conjunction with perpendicular planes C and D. Plane C bisects the lens 100 horizontally along line B—B of FIG. 1, passing through center point 250 and including radii 215 defining the horizontal curvature 210 of the lens surfaces 120, 140. Plane D vertically bisects the lens along line A—A of FIG. 1.

An optical axis 200 passes through center point 250 perpendicular to a tangent T to the lens surface at the center point 250. Light reflected from a parabolic reflector will encounter the inside surface of the lens 140 substantially parallel to the optical axis 200. This being known, the configuration and orientation of each prismatic element P can be selected to define a prismatic matrix that refracts light through each prismatic element P to emerge from the front surface of the lens 120 at a desired angle. Arc 300 illustrates the desired 90° wide-angle radiation pattern. The radiation pattern produced by such a prismatic matrix is horizontal or parallel to plane C.

Figure 4:
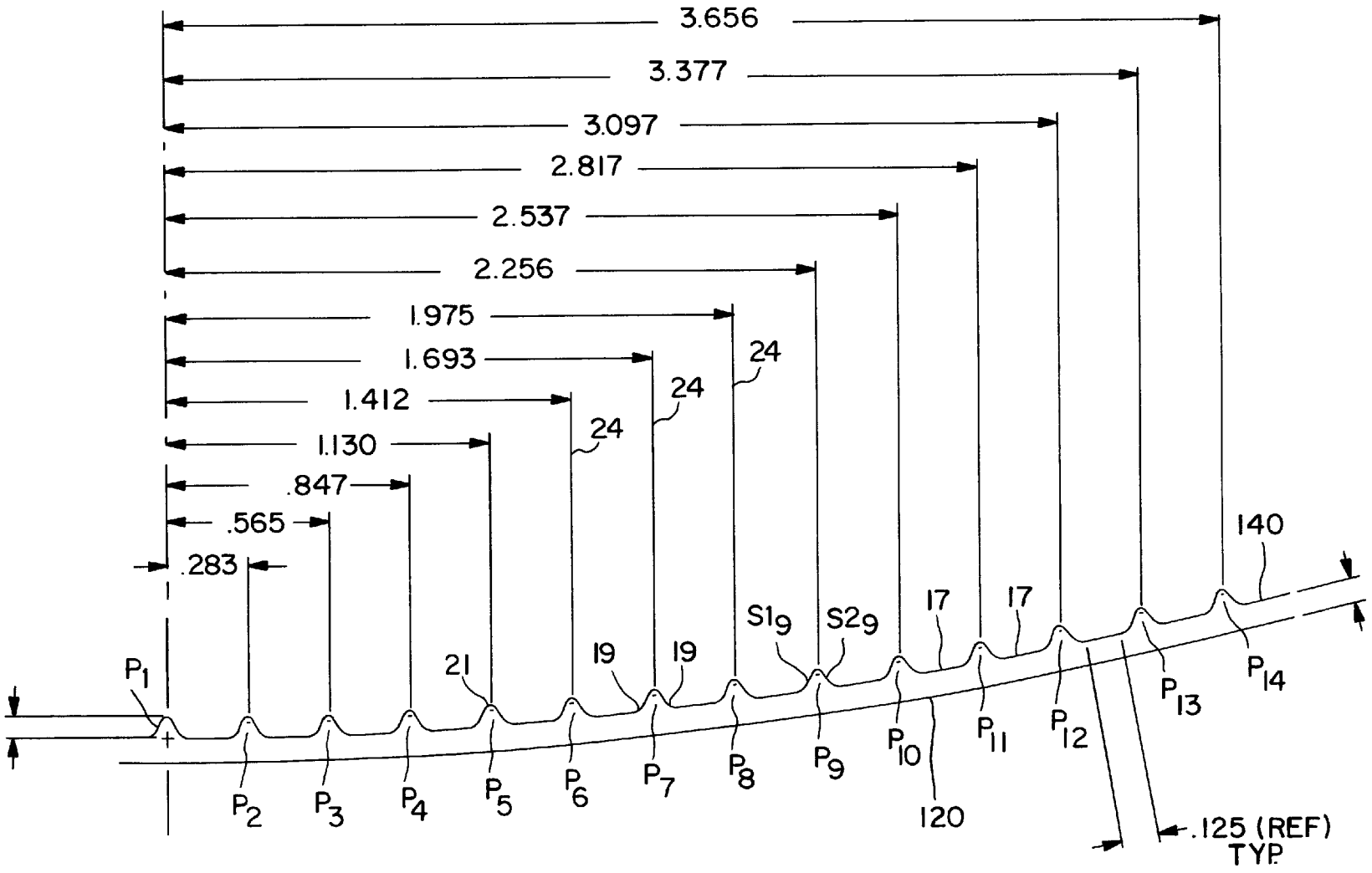
FIG. 4 is an enlarged partial view taken from within the dashed oval of FIG. 2 showing the arrangement of prismatic elements on the inner surface of the lens.

FIG. 4 is an enlarged view of the portion of FIG. 2 within the dashed oval. Prismatic elements $P_1$–$P_{14}$ are substantially equally spaced from each other across the inside surface 140 of the lens. Prismatic element $P_1$ is centered on line A—A passing vertically through the center of the lens. One half of the prismatic matrix is shown, with the other half being an identical mirror image also commencing with prismatic element $P_1$.

Figure 10:
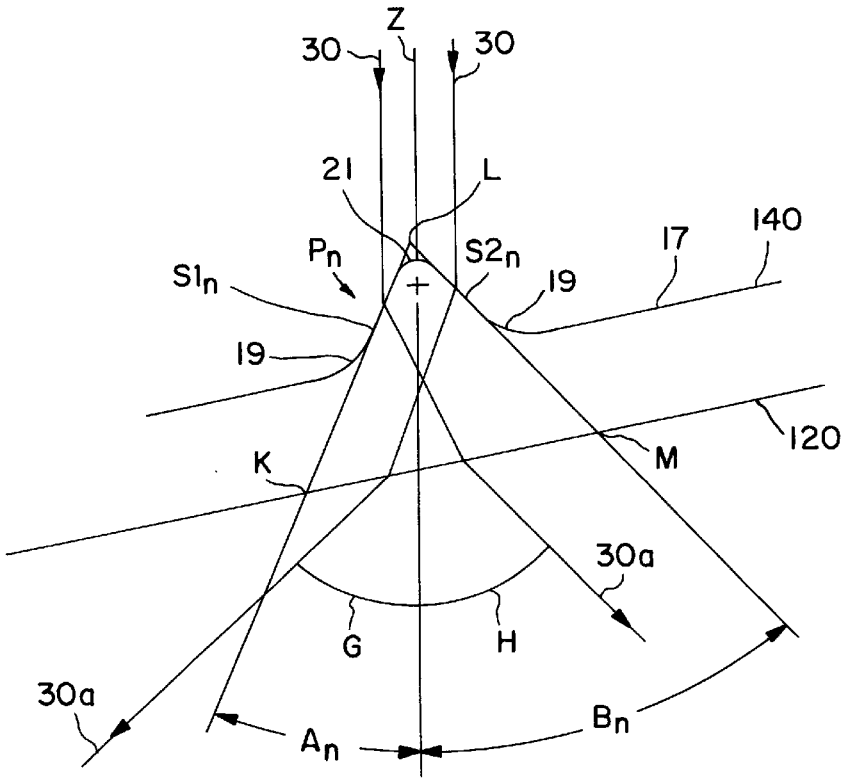
FIG. 10 is an enlarged diagram of FIG. 7 further illustrating optical paths of light passing through a single prismatic element.

A single prismatic element $P_n$ is enlarged in FIG. 10 for the purpose of illustrating the behavior of light passing through each prismatic element P. Points K, L and M define the three corners of a hypothetical prism that can be used to describe the behavior of light passing through prismatic element $P_n$. Prism KLM is comprised of three optical surfaces, planar surfaces $S1_n$ and $S2_n$ and the outside surface of the lens 120. Rays of reflected light 30 are incident on the inner surface 140 of the lens parallel to optical axis 200. Rays of reflected light 30 incident on the planar surfaces $S1_n$ $S2_n$ of each prismatic element $P_n$ are refracted upon entering the lens material and again upon leaving the front surface of the lens to project away from the lens at angles G and H, respectively, relative to their initial orientation.

Each prismatic element P is configured so that rays 30*a* emerging from the lens are deflected horizontally at an angle of 45° (angles G and H) to either side of the warning light. Together, angles G and H define an arc of 90° (arc 300). This consistent pattern of refraction produces a concentration of light horizontally offset to either side of a warning light equipped with the lens 100. Reflected light incident upon the concave surfaces 19 and convex surface 21 of each prismatic element P is spread within the 90° arc of the wide-angle radiation pattern.

Figure 6:
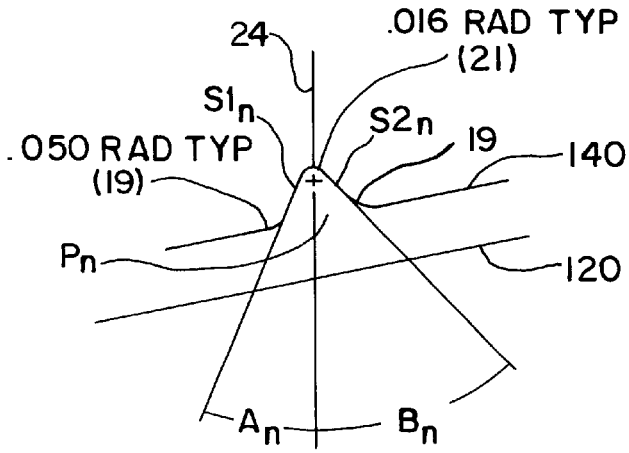
FIG. 6 is a diagram exemplary of a single prismatic element illustrating the angles of each planar surface with respect to a line normal to the warning light.

With reference to FIGS. 4 and 6, the configuration of each prismatic element P is selected to produce the light refraction pattern described above with reference to FIGS. 9 and 10. Prismatic elements $P_1$–$P_{14}$ are substantially equally spaced across the inner surface 140 of the lens. A series of parallel lines 24 passing through each prismatic element illustrate the path of reflected light incident on the inner surface 140 of the lens. Lines 24 are also parallel to the optical axis 200. Planar surfaces S1 and S2 each have an angular orientation with reference to reflected light represented by lines 24. In FIG. 6, planar surface $S1_n$ is disposed at angle $A_n$ with respect to line 24 and planar surface $S2_n$ is disposed at angle $B_n$ with respect to line 24. The angular orientation of planar surfaces $S1_n$ and $S2_n$ are selected for each prismatic element $P_n$ to produce a prismatic matrix having the desired radiation pattern. Table 1 below specfic values for angle $A_n$ and angle $B_n$ for each prismatic element $P_n$ identified in FIG. 4.

TABLE 1

| PRISMATIC ELEMENT NUMBER $P_n$ | ANGLE $A_n$ | ANGLE $B_n$ |
|---|---|---|
| 1 | 30.5° | 30.5° |
| 2 | 30° | 31° |
| 3 | 29° | 32° |
| 4 | 28.5° | 33° |
| 5 | 27.5° | 34° |
| 6 | 27° | 34.5° |
| 7 | 26° | 35.5° |

TABLE 1-continued

| PRISMATIC ELEMENT NUMBER $P_n$ | ANGLE $A_n$ | ANGLE $B_n$ |
|---|---|---|
| 8 | 25.5° | 36.5° |
| 9 | 25° | 37.5° |
| 10 | 24° | 38.5° |
| 11 | 23.5° | 39.5° |
| 12 | 23° | 40.5° |
| 13 | 22.5° | 41.5° |
| 14 | 21.5° | 42.5° |

In the preferred embodiment, each prismatic element P projects 0.070" from the inner surface to the apex of the convex surface 21. The lens outer and inner surfaces 120, 140 are spaced apart to define a lens having a 0.080" thickness at the spaces 17 between prismatic elements P. A preferred lens material is LEXAN$^R$, produced by GE Plastics, due to its durability, optical clarity and relatively high index of refraction. Other materals,such as glass or alternative clear plastic materials may also be appropiate. Of course, the configuration of the prismatic elements 16 must be optimized for the index of refraction of the lens material selected.

Figure 7:
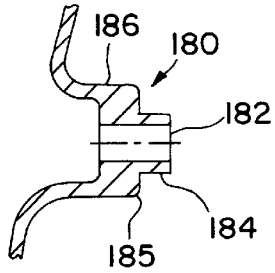
FIG. 7 is a partial sectional view through the lens mount of FIG. 5 and 5A.

FIG. 7 illustrates a sectional view through a mounting projection 180. Each mounting projection 180 comprises a.first, enlarged-diameter portion 186 and a second, reduced-diameter portion 184, portions 186 and 184 being interconnected by an intermediate shoulder 185. Each mounting projection 180 defines a bore 182 for receiving a mounting fastener (not illustrated) for securing the lens to a mounting structure.

It should be understood that, while a rectangular warning light having a particular convex lens and prismatic element configuration has been described herein, the principles of the invention are also applicable to other shapes of lens and is further applicable to lenses used to produce an illumination pattern.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A lens for a warning light comprising:

a convex outer and generally parallel concave inner surface, said outer and inner surfaces defining a first radius of curvature and a center point and having an optical axis perpendicular to a tangent to said lens at said center point, a matrix of substantially parallel prismatic elements projecting from said inner surface and transversely spaced relative to said optical axis and defined by first and second refractive surfaces, each of said first and second refractive surfaces being disposed at a selected angular orientation relative to said optical axis so that light parallel to said optical axis and incident upon a particular point of each said prismatic element is refracted by said prismatic element to exit said outer surface at a substantially similar angle relative to said optical axis.

2. The lens of claim 1, wherein said first and second refractive surfaces converge at a point inwardly of said inner surface to define a generally triangular rib.

3. The lens of claim 2, wherein said lens is bisected by a first plane containing said optical axis and radii of said first radius of curvature and a second plane containing said optical axis and perpendicular to said first plane, said prismatic elements being parallel to said second plane and transversely spaced.

4. The lens of claim 3, wherein the distances between each said prismatic element and an adjacent prismatic element are substantially equal.

5. The lens of claim 2, wherein each said prismatic element is separated from an adjacent prismatic element by a lens portion having a generally uniform thickness.

6. The lens of claim 2, wherein the convergence of said first and second refractive surfaces is defined by a third radius of curvature so that each said prismatic element includes a convex inward projecting apex.

7. The lens of claim 6, wherein said first and second refractive surfaces intersect said inner surface at a junction, said junction comprising a concave surface having a fourth radius of curvature.

8. The lens of claim 7, wherein said third radius of curvature is smaller than said fourth radius of curvature.

9. A lens for a warning light of the type having a concave reflecting surface defining at least one paraboloid of revolution and at least one light source positioned at the focus of the reflecting surface, wherein light from the light source incident upon the reflecting surface is directed away from the reflecting surface parallel to an optical axis perpendicular to the reflecting surface and passing through a center point of the reflecting surface, the lens defining a concave inner surface facing the reflector and including light-spreading optical elements, wherein the improvement comprises:

each said optical element is defined by first and second refractive surfaces, each of said first and second refractive surfaces being disposed at a pre-established angular orientation relative to said optical axis, the angular orientation of each said first and second refractive surface being a function of the curvature of said inner surface and the refractive properties of the prismatic element so that light parallel to said optical axis and incident upon a particular point of each said prismatic element is refracted by said prismatic element to exit said lens at a substantially identical exit angle relative to said optical axis and light parallel to said optical axis and incident upon a portion of the lens between adjacent optical elements is directed at a second exit angle substantially parallel to said optical axis.

10. The lens of claim 9, wherein said exit angle is approximately 45°.

11. The lens of claim 9, wherein said first and second refractive surfaces converge at an apex inwardly of said inner surface to define a generally triangular rib.

12. The lens of claim 11, wherein said ribs are substantially parallel and substantially equally separated by portions of said lens inside surface to define a prismatic matrix.

13. The lens of claim 11, wherein the apex of said first and second refractive surfaces is defined by a radius so that each said rib includes a convex inward projecting apex.

14. The lens of claim 13, wherein each of said first and second refractive surfaces intersect said inner surface at a junction, said junction comprising a concave surface.

15. A lens for use in conjunction with a warning light, said warning light including a parabolic reflector having a focus and a light source positioned at the focus of the reflector, said lens comprising:

a convex outer surface having a first radius of curvature, a concave inner surface spaced from said outer surface and sharing said first radius of curvature, said inner surface disposed about a center point and having an optical axis perpendicular to a tangent to said inner surface passing through said center point, said inner surface including a matrix of spaced apart substantially parallel prismatic elements projecting toward the reflector, said prismatic elements defined by first and second refractive surfaces, each of said first and second refractive surfaces being disposed at a selected angular orientation relative to said optical axis so that a ray of light parallel to said optical axis and incident upon a particular point of each said prismatic element is refracted by said prismatic element to exit said lens outer surface at a substantially identical angular orientation relative to said optical axis.

16. The lens of claim 15, wherein said substantially identical angular orientation relative to said optical axis is an angle of 45°.

17. The lens of claim 15, wherein said prismatic elements are substantially equally spaced apart.

18. The lens of claim 15, wherein said first and second refractive surfaces converge to meet at a point inward of said inner surface to define a generally triangular rib.

19. The lens of claim 18, wherein the convergence of said first and second refractive surfaces is defined by a third radius of curvature so that each said rib includes a convex apex.

20. The lens of claim 19, wherein said first and second refractive surfaces meet said inner surface at a junction, said junction comprising a concave surface.

* * * * *